US007575042B2

(12) United States Patent
Bewlay et al.

(10) Patent No.: US 7,575,042 B2
(45) Date of Patent: Aug. 18, 2009

(54) METHODS FOR THE FORMATION OF REFRACTORY METAL INTERMETALLIC COMPOSITES, AND RELATED ARTICLES AND COMPOSITIONS

(75) Inventors: Bernard Patrick Bewlay, Schenectady, NY (US); Melvin Robert Jackson, Corea, ME (US)

(73) Assignee: General Electric Company, Niskayuna, NY (US)

( * ) Notice: Subject to any disclaimer, the term of this patent is extended or adjusted under 35 U.S.C. 154(b) by 11 days.

(21) Appl. No.: 11/393,591

(22) Filed: Mar. 30, 2006

(65) Prior Publication Data

US 2009/0178775 A1 Jul. 16, 2009

(51) Int. Cl.

| | |
|---|---|
| ***B22C 1/00*** | (2006.01) |
| ***B22C 3/00*** | (2006.01) |
| ***B22C 9/00*** | (2006.01) |
| ***B28B 7/00*** | (2006.01) |

(52) U.S. Cl. ..... 164/519; 164/138; 164/517; 164/361; 106/38.27; 106/38.9

(58) Field of Classification Search ..... 164/138, 164/518, 519, 528, 517, 361; 106/38.27, 106/38.3, 38.9

See application file for complete search history.

(56) References Cited

U.S. PATENT DOCUMENTS

| | | | | |
|---|---|---|---|---|
| 4,664,172 | A * | 5/1987 | Takayanagi | 164/34 |
| 4,980,244 | A | 12/1990 | Jackson | |
| 5,721,061 | A | 2/1998 | Jackson et al. | |
| 5,833,773 | A | 11/1998 | Bewlay et al. | |
| 5,932,033 | A | 8/1999 | Jackson et al. | |
| 6,220,817 | B1 | 4/2001 | Durgin et al. | |
| 6,419,765 | B1 | 7/2002 | Jackson et al. | |
| 6,428,910 | B1 | 8/2002 | Jackson et al. | |
| 6,497,968 | B2 * | 12/2002 | Zhao et al. | 428/663 |
| 6,521,356 | B2 * | 2/2003 | Zhao et al. | 428/632 |
| 6,676,381 | B2 * | 1/2004 | Subramanian et al. | 415/241 B |
| 6,749,006 | B1 | 1/2004 | Yang et al. | |
| 7,296,616 | B2 * | 11/2007 | Bewlay et al. | 164/519 |
| 2006/0130996 | A1 | 6/2006 | Bewlay et al. | |

OTHER PUBLICATIONS

B. P. Bewlay et al., "Shell Mold for Casting Niobium-Silicide Alloys, and Related Compositions and Processes", filed Dec. 22, 2004, U.S. Appl. No. 11/020,519, GE Document No. 154983-1.

K.L. Luthra et al., "Coating/Substrate Interactions at High Temperature," Symposium on High Temperature Coatings, Oct. 7, 1986, pp. 85-100.

(Continued)

*Primary Examiner*—Kevin P Kerns
(74) *Attorney, Agent, or Firm*—Francis T. Coppa

(57) ABSTRACT

A method for forming an article is described. The method includes the step of applying a precursor material to at least one surface of a mold structure for casting the article, and curing the applied precursor material. The precursor material includes facecoat-forming constituents which can be curably converted into a facecoat; and a protective coating-former for the article being cast. Molten material is then introduced into the mold structure, so as to come in contact with the facecoat formed from the cured precursor material. The molten material is cooled, to form the article. The cured precursor material, which is in contact with a surface of the cast article, is then reacted with the article, to form the protective coating on the surface of the article. Related mold structures are also described.

37 Claims, 5 Drawing Sheets

OTHER PUBLICATIONS

B.P. Bewlay et al., "Intermetallic Compounds—Principles and Practice," vol. 3, Progress, Chapter 26, Niobium Silicide High Temperature in Situ Composites, Aug. 1, 2002, pp. 541-560.

B.P. Bewlay et al, "Processing High-Temperature Refractory-Metal Silicide In-Situ Composites," Minerals Metals & Materials Society, Warrendale, Pa., vol. 51, No. 4, Apr. 1999, pp. 32-36.

P. Rodhammer et al., "Protection of Nb and Ta-Based Alloys Against High Temperature Oxidation," International Journal of Refractory metals and hard materials, 1993-1994 Elsevier Science Ltd., Oxford, England, vol. 12, No. 5, 1993, pp. 283-293.

EP Search Report, EP07104494, May 22, 2007.

* cited by examiner

METHODS FOR THE FORMATION OF REFRACTORY METAL INTERMETALLIC COMPOSITES, AND RELATED ARTICLES AND COMPOSITIONS

BACKGROUND OF THE INVENTION

This invention generally relates to refractory metal intermetallic composites. Some specific embodiments of the invention are directed to methods for casting such composites and providing them with protective coatings.

Turbines and other types of high-performance equipment are designed to operate in a very demanding environment which always includes high-temperature exposure, and often includes high stress and high pressure. Superalloys based on elements like nickel or cobalt have often provided the chemical and physical properties required for such operating conditions.

While the attributes of superalloys continue to ensure considerable interest in such materials, new compositions have been developed to meet an ever-increasing threshold for high-temperature exposure. Prominent among such materials are the refractory metal intermetallic composites (RMIC's). Examples include various niobium-silicide alloys. (The RMIC materials may also include a variety of other elements, such as titanium, hafnium, aluminum, and chromium). These materials generally have much greater temperature capabilities than the current class of superalloys. As an illustration, while many nickel-based superalloys have an operating temperature limit of about 1100° C., many RMIC alloys have an operating temperature in the range of about 1200° C.-1700° C. These temperature capabilities provide tremendous opportunities for future applications of the RMIC alloys. Moreover, the alloys are considerably lighter than many of the nickel-based superalloys.

Clearly, RMIC alloys possess very attractive properties which make the materials desirable for many demanding applications. However, continued improvement in some areas would be welcome in the art. One area of need for some embodiments relates to environmental protection, e.g., resistance to oxidation and corrosion. For example, at temperatures above about 1090° C., some of the Nb-based RMIC alloys can undergo rapid oxidation. While a slow-growing oxide scale can form on the alloys at this temperature, it is not typically a protective oxide scale. Moreover, another type of undesirable oxidation known as "pesting" can sometimes occur at intermediate temperatures, e.g., in the range of about 600° C.-980° C. (1112° F.-1800° F.). Refractory metals, particularly molybdenum, sometimes exhibit relatively low resistance to pesting oxidation.

In order to increase oxidation resistance through various temperature ranges, a number of protective coatings for RMIC articles have been developed. Many of them are described in U.S. Pat. Nos. 5,721,061 (Jackson and Ritter) and 6,497,968 (Zhao, Bewlay, and Jackson). Most of these coatings are silicon-based, and also include chromium and titanium. Most (though not all) of the coatings also include niobium, along with other optional elements. When applied on a cast RMIC article and heat-treated, the protective coatings often contain a chromium-rich phase.

While these protective coatings are generally effective in minimizing the problems of oxidation, their deposition and formation can sometimes be time-consuming and difficult. As an example, the coating constituents often have to be carefully pre-mixed in a suitable slurry which then must be carefully sprayed or painted onto the RMIC article. Heat treatments must often be undertaken to cure the coating and promote reaction of the coating constituents with each other, and with the RMIC surface. Moreover, the application of the protective coatings to various cavities and apertures can be difficult and incomplete. For example, turbine blades made from RMIC alloys usually include radial cooling holes or serpentine passageways which can extend entirely through the part. It can be very difficult to physically apply an adherent protective coating through such a length.

RMIC materials, like nickel and cobalt superalloys, can be cast into useful articles by various techniques. One of the most popular techniques is investment casting, sometimes referred to as the "lost wax process". The overall process usually begins with the construction of a shell mold. Typically, a wax model is dipped into a slurry comprising a binder and a refractory material, so as to coat the model with a layer of slurry. (The binder is often a silica-based material). Additional layers of dry refractory material and stucco-slurry layers are applied as appropriate, to form a shell mold around the wax model, having a suitable thickness. After thorough drying, the wax model is eliminated from the shell mold, and the mold is fired. In the actual casting step, molten material for the desired alloy is introduced into the shell mold by various conventional techniques. The molten material is then cooled to form a solid cast article. In many instances, one or more cores are incorporated into the shell mold, to provide the various holes and passageways described previously. The core material is later removed from the final casting by conventional techniques.

While shell mold structures are very suitable for casting RMIC alloys in many situations, some serious drawbacks and other considerations are associated with their use. For example, niobium-silicides are chemically-reactive materials which can react with the silica in the wall of a shell mold. This type of reaction can result in serious surface defects in the cast article. These defects can limit precision casting. In some cases, over-size parts must be cast and then machined-to-size in order to remove the surface defects.

Many of these drawbacks are addressed by the use of facecoats, which form a protective barrier between the molten RMIC casting metal and the surface of the shell mold. For example, U.S. Pat. No. 6,676,381 (Subramanian et al) describes a facecoat based on yttria or at least one rare earth metal and other inorganic components, such as oxides, silicides, silicates, and sulfides. The facecoat compositions are most often in the form of a slurry which includes a binder material, along with a refractory material like the yttria component. When a molten, reactive casting metal is delivered into the shell mold, the facecoat prevents the undesirable reaction between the casting metal and the walls of the mold, i.e., the walls underneath the facecoat. Facecoats can sometimes be used, for the same purpose, to protect the portion of a core within the shell mold, which would normally come into contact with the casting metal. While facecoats are very effective for these purposes, their use requires additional materials and process steps for the overall manufacturing process.

In view of the various considerations set forth above, it should be apparent that additional advancements in RMIC technology would be welcome in the art. Improvements directed to the casting processes for RMIC alloys would be of substantial value. Improvements for applying protective coatings to both the external and internal surfaces of the cast articles would also be of special interest. Any increase in casting and coating efficiency would be very beneficial in commercial production facilities.

BRIEF DESCRIPTION OF THE INVENTION

One embodiment of this invention is directed to a method for forming an article, comprising the following steps:

(i) applying a precursor material to at least one surface of a mold structure, and curing the applied precursor material, wherein the precursor material comprises
  (a) facecoat-forming constituents which can be curably converted into a facecoat capable of preventing substantial reaction between the mold structure surface and an article being cast in the mold structure; and
  (b) a protective coating-former for the article being cast;

(ii) introducing a molten material into the mold structure, and in contact with the facecoat formed from the cured precursor material;

(iii) cooling the molten material, to form the cast article within the mold structure, wherein a surface of the cast article is in contact with the cured precursor material; and (iv) reacting the cured precursor material with the cast article, to form the protective coating on the surface of the cast article.

Another embodiment of the invention is directed to a precursor material for application to at least one surface of a mold structure suitable for casting refractory metal intermetallic composites. The precursor material comprises:

(A) at least one facecoat-forming constituent suitable for conversion into a facecoat capable of preventing substantial reaction between a surface of the mold structure and an article being cast in the mold structure; and (B) a protective coating-former for the article being cast.

An additional embodiment relates to a mold structure for casting molten material to form an article, comprising (I) a shell for containing the molten material; and (II) a precursor material disposed on at least one surface of the mold structure, comprising:
  (a) facecoat-forming constituents which can be curably converted into a facecoat capable of preventing substantial reaction between the mold structure surface and an article being cast in the mold structure; and
  (b) a protective coating-former for the article being cast.

DETAILED DESCRIPTION OF THE INVENTION

Figure 1:
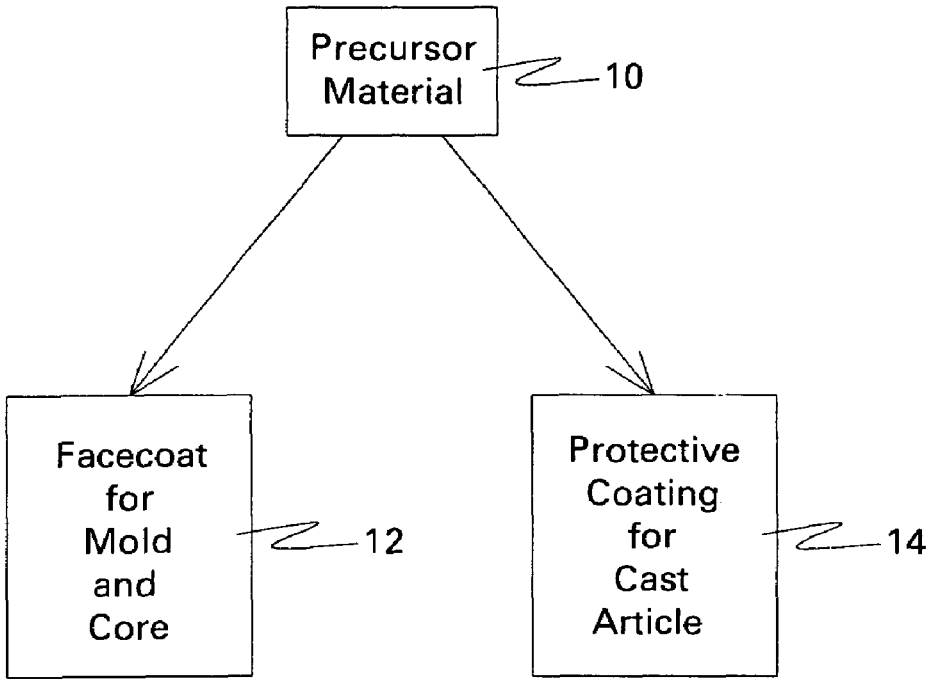
FIG. 1 is a simplified diagram which illustrates the function of the precursor material described in this disclosure.

In one embodiment of the present invention, a precursor material is applied to at least one surface of a mold structure. As used herein, the term "mold structure" or "mold system" is meant to include the mold itself, e.g., the walls of a shell mold which define the shape of articles cast within it. The mold structure also includes any cores which are incorporated within the confines of the mold. FIG. 1 is a simplified depiction of the process. A precursor material 10 is applied to a desired surface of a mold structure. Precursor 10 is eventually transformed into both a facecoat 12 for the mold and core(s), and a protective coating 14 for the cast article, as discussed below.

Shell molds are often the choice for casting niobium-based RMIC materials. Suitable shell molds are described, for example, in pending patent application Ser. No. 11/020,519 (154983-1) for B. Bewlay et al, filed on Dec. 22, 2004, and incorporated herein by reference. A variety of materials can be used to form the shell mold. Non-limiting examples include YAG materials, as well as various alumina- and aluminate-type materials. Other shell mold materials comprise at least one compound selected from the group consisting of yttrium silicates, zirconium silicates (e.g., $ZrSiO_4$ or $ZrO_2.SiO_2$), hafnium silicates (e.g., $HfSiO_4$), and rare earth-silicates. Some of the useful silicates have the following formulae (or combinations thereof):

$$R_2O_3.SiO_2; \quad \text{(i)}$$

$$2R_2O_3.3SiO_2; \text{ or} \quad \text{(ii)}$$

$$R_2O_3.2SiO_2, \quad \text{(iii)}$$

wherein R is yttrium or at least one rare earth element. (In general, the shell mold composition can often comprise rare earth metals or rare earth oxides, or some combination thereof).

Many different combinations of the compounds generally referenced above are possible. For example, mixtures comprising one or more of each type of silicate could be employed, as well as mixtures of the different metal silicates, e.g., mixtures of one or more yttrium silicates with a zirconium silicate and/or a hafnium silicate. Moreover, those skilled in the art understand that the oxygen content of the various silicates covered by the formulae listed above can vary significantly, while the crystal structure of the compound remains the same. Those variations are considered to be within the scope of this invention. In some embodiments, the preferred rare earth metals for the shell mold compositions are dysprosium, erbium, and ytterbium.

In some preferred embodiments, the shell mold comprises a material selected from the group consisting of yttria (yttrium oxide), at least one yttrium silicate, and a combination of yttria and at least one yttrium silicate. The preferred yttrium silicate for some embodiments is yttrium monosilicate (known as $Y_2SiO_5$ or $Y_2O_3.SiO_2$), due in part to its excellent refractory characteristics.

Shell molds and other mold structures can be fabricated by a variety of methods. Very often, the mold is made by building ceramic-type layers on a wax pattern (or multiple wax patterns) of the desired mold structure. As one example, the referenced patent application (Ser. No. 11/020,519) describes suitable techniques for constructing the shell, using various sequences of dry refractory layers and stucco-slurry layers. The layers are applied until a selected thickness is obtained for the mold walls. The composition of the layers can also be varied considerably, to obtain a shell mold with specific properties for specific regions within the mold walls. After the mold structure is complete, the wax pattern can be removed by conventional de-waxing procedures. The shell mold is usually heat-treated, e.g., by firing according to conventional techniques. Those skilled in the art are familiar with factors related to the selection of a heating regimen. Many variations on the heating scheme are possible, e.g., the implementation of a pre-firing procedure (at lower temperatures), prior to firing at higher temperatures. Other details regarding shell mold construction are also well-known. For example, U.S. Pat. No. 6,749,006 (Yang et al) is instructive, and is incorporated herein by reference. (In some cases, the layers which form the shell mold are compositionally graded, as described in the referenced Bewlay et al application Ser. No. 11/020,519).

As mentioned above, the precursor material comprises at least two components. The first component is a facecoat-forming constituent, while the second component is a protective coating-former. Under most service conditions, the facecoat-forming components which adhere to the cast article can be removed by techniques similar to those used to remove the bulk of the mold (or core) ceramic structure, after casting. The protective coating-former is intended to remain adherent to, and integral with, the cast part. For simplicity, the "facecoat-forming constituent" will sometimes be referred to herein as the "facecoat constituent" or the "facecoat", while the "protective coating-former" will sometimes be referred to as the "protective coating".

As described previously, the facecoat-forming constituent is often one or more oxides, silicides, silicates, oxysulfides, sulfides, or other materials, such as garnet (a silicate mineral), alumina, and aluminates (under which "garnet" is sometimes classified). Combinations of any of the foregoing are also possible. Metallic components within the facecoat-forming composition are usually selected from the group consisting of rare earth metals, refractory metals, and combinations thereof. Non-limiting examples of oxides for the facecoat-forming composition are as follows: hafnia, titania, zirconia, yttria, silica, and magnesia. In preferred embodiments, the facecoat-former comprises a refractory material, i.e., a ceramic capable of withstanding the temperature at which the metal alloy is to be cast (at least about 1700° C. in the case of most niobium-silicide alloys).

Exemplary facecoat compositions (as formed) are described in U.S. Pat. No. 6,676,381 of Subramanian et al, which is incorporated herein by reference. In the case of shell molds, the facecoat is often (though not always) a material which is similar or identical to the shell material. Thus, the facecoat can be formed from the same base material, e.g., the same slurry, or a similar slurry. As an example, the facecoat often comprises at least one compound selected from the group consisting of yttrium silicates, zirconium silicates, hafnium silicates, and rare earth-silicates (like those described previously), as well as reaction products formed when the facecoat is heat-treated.

In some preferred embodiments, the facecoat-forming constituents comprise yttrium monosilicate and free yttria. (As used herein, "free yttria" is meant to describe yttria which is not chemically bonded to any other species, e.g., to a metal to form a silicate.). Moreover, in some especially preferred embodiments, the facecoat-forming constituents comprise at least about 50% by weight to about 99% by weight total yttria (free, or in silicate-form), based on the total weight of the constituent. The use of substantial amounts of yttria provides a high degree of refractory character to the facecoat. The relatively high amounts of yttria also provide the chemical inertness necessary to prevent substantial reaction between the material being cast (e.g., niobium silicon-rich alloys) and the mold walls. ("Substantial reaction" as used herein refers to a reaction which would result in a cast part having properties unacceptable for a selected end use).

As further described below, the facecoat-forming constituents like free yttria and yttrium monosilicate should be in substantial thermodynamic equilibrium ("pseudo-equilibrium") with the protective coating-forming constituents, during the above-mentioned steps (ii) and (iii). (Step (ii) includes the introduction of the molten casting material into the mold, while step (iii) involves cooling the molten material in the mold). The equilibrium state results in the tendency of oxygen associated with the yttrium-containing components to remain with the yttrium components during these process steps. Thus, the oxygen would not have the tendency to become associated with the protective coating constituents, where it could prevent the formation of a stable protective coating, as described below.

The second component of the precursor material is a protective coating-former for the article being cast. As used herein, "protective coating-former" is meant to describe a material which will form a protective coating on the substrate after it has been deposited thereon. Formation can take place as a result of chemical reaction, thermal treatment, and the like, although in some instances, the coating may not change significantly in composition after its deposition. As used herein, a "protective coating" is meant to describe a coating which can provide one or more various attributes. For example, the coating may be one which provides environmental resistance (e.g., oxidation-resistance), or abrasion (wear) resistance. Moreover, the coating may serve as a bondcoat, promoting adhesion of a subsequently applied ceramic layer (e.g., a thermal barrier coating), as described below.

In general, many of the protective coatings for RMIC articles are known in the art. Methods for preparing the coatings (e.g., using coating precursors) are also familiar to those skilled in the art. As an example, suitable coatings are described in U.S. Pat. Nos. 4,980,244 (Jackson); 5,721,061 (Jackson and Ritter); 6,497,968 (Zhao, Bewlay, and Jackson); and 6,521,356 (Zhao, Jackson, and Bewlay), which are incorporated herein by reference. The protective coating-former (e.g., a bondcoat-former) should have a melting temperature which is higher than the mold temperature (i.e., the mold structure itself), during casting.

As mentioned above, the protective coating-former preferably comprises constituents which are in substantial thermodynamic equilibrium with the facecoat-forming constituents during the above-mentioned steps (ii) and (iii). The state of substantial equilibrium ("pseudo-equilibrium") functions to prevent premature reaction of the constituents prior to step (iv), i.e., the step at which the precursor material is reacted with the cast article. It should also be emphasized that the equilibrium state depends not only on coating precursor composition, but also on mold temperature during casting; hold-time in the mold; the environment of the mold chamber (e.g., whether air, vacuum, or an inert atmosphere); and the protective coating-forming temperature.

The constituents of the protective coating-former are selected so that the coating, as-formed, has a melting temperature substantially above the maximum service temperature of the coating, and at least as high as that used in any thermal treatment after casting. As an illustration, if the cast article is to be used in a service environment with peak temperatures of about 1100° C. to about 1200° C., the protective coating preferably has a melting temperature which is at least about 200° C. higher, e.g., about 1300° C. to about 1400° C. As mentioned above, it is intended that the protective coating constituents remain in-situ, and are not eroded away during the casting of the liquid into the mold. Thus, the constituents should not be in a substantially liquid state at mold pre-heat temperatures, or slightly above those temperatures. (Usually, the metal being cast will quickly cool as it contacts the surface of the mold).

Very often, the protective coating-former comprises silicon, chromium, and titanium. In many embodiments, silicon is usually present at about 50 atom % to about 90 atom %. In some specific embodiments, silicon is present at about 60 atom % to about 80 atom %.

Chromium is usually present at about 2 atom % to about 45 atom %. In some specific embodiments, chromium is present at about 5 atom % to about 20 atom %. Moreover, the third component mentioned above, titanium, is usually present at about 2 atom % to about 35 atom %, and in some specific embodiments, is present at about 5 atom % to about 20 atom %.

In some preferred embodiments, the protective coating further comprises niobium. When included, niobium is usually present at about 1 atom % to about 35 atom %. In some specific embodiments, the amount of niobium is in the range of about 10 atom % to about 25 atom %.

The protective coating can also include one or more other elements which impart desirable properties for some coating functions. Non-limiting examples of these elements include iron, hafnium, germanium, and aluminum. A typical amount of iron is about 2 atom % to about 25 atom %. A typical amount of hafnium is about 2 atom % to about 15 atom %. A typical amount of germanium is about 10 atom % to about 30 atom %. A typical amount of aluminum is about 5 atom % to about 30 atom %.

A variety of other elements may also be present, at relatively minor levels. Non-limiting examples include tungsten, molybdenum, tin, nickel, and the rare earth metals. Those skilled in the art will be able to select particular elements and amounts, based on various factors, such as the type of article being covered with the coating; and the contemplated end use for the article. The protective-coating former may also include constituents which provide wear-resistance to the coating. Non-limiting examples of such materials include carbides, e.g., titanium carbide, silicon carbide, tungsten carbide, or precursors to such materials.

In some preferred embodiments, the protective coating-former contains a chromium-disilicide phase. Such a phase is often very desirable for a number of reasons. For example, it has a melting point high enough to withstand subsequent heat-treatment of the coating-former. The chromium-disilicide phase is also a good source of chromium and silicon for the final coating. Thus, reaction step (iv), discussed below, is usually carried out under temperature conditions sufficient to ensure formation of this phase, in preference to the formation of chromium silicate phases. (The undesirable chromium silicate phases would tend to form when oxygen from the facecoat constituents becomes associated with the protective coating constituents).

The precursor material can be prepared by a variety of techniques. For example, the individual components, e.g., the facecoat- and protective coating materials, can be dry-mixed together, or combined in a suitable slurry (with or without pre-mixing), e.g., using a solvent such as water, alcohols, other organic materials, or silicone oils. One type of slurry for silica-containing precursors is based on colloidal silica. Those skilled in the art are familiar with colloidal silica slurries. In brief, the colloidal solution is usually diluted with de-ionized water, to vary the silica content. The slurries usually contain other additives, such as wetting agents, which ensure proper wetting of the wax pattern. Defoaming agents and viscosity-control agents are also typically included. Moreover, the slurries are preferably maintained at a pH suitable for ensuring stability.

The precursor material can be applied to one or more surfaces of the mold structure by a variety of techniques. Non-limiting examples include brushing or painting. Typically, the material is applied by dipping the component in a suitable slurry which contains coating constituents, followed by one or more heat treatments. In some cases, e.g., in applying the precursor material to a core, spray techniques can effectively be used. Examples include plasma deposition (e.g., ion plasma deposition vacuum plasma spraying), high velocity oxy-flame (HVOF) techniques; PVD, and CVD. Moreover, various combinations of any of these deposition techniques could be employed.

In the case of a shell mold prepared by building ceramic-type layers on a wax pattern, the precursor material could be applied in the form of one or more of the layers of the shell. The referenced application Ser. No. 11/020,519 (154983-1), describes various details on forming such a shell as a series of refractory layers and stucco-slurry layers. As an illustration for the present invention, one or more of the initial layers formed (e.g., about 1-8 layers) could comprise the precursor material. These layers, closest to the wax pattern which serves as the base of the shell mold, would eventually become the outermost layers of the mold, following removal of the wax pattern.

After the precursor material has been applied, it is usually subjected to a curing step. The curing step removes volatile materials, while increasing green strength (and often increasing density), thereby resulting in the formation of a functional facecoat. In some instances, the step of removing the volatiles (e.g., using a vacuum) itself results in sufficient curing. More often, though, curing is carried out by a heat treatment. The heat treatment should be high enough to achieve these objectives and provide a refractory characteristic to the facecoat formed with the precursor, but low enough to prevent reaction of any of the protective coating constituents with the facecoat-forming constituents. Thus, the temperature should also be low enough to prevent or minimize any reaction which would impede the reaction of the protective coating-portion of the material with the subsequently-cast metallic article. In some instances, the curing should be carried out in an atmosphere free of oxygen, to minimize oxidation of the protective coating constituents. Moreover, in some embodiments, the heat treatment could be carried out as part of a pre-firing step which is sometimes employed to treat completed shell molds.

The thickness of the precursor material will depend on various factors. Exemplary factors include the particular composition of the precursor; the desired, final thickness for the facecoat and the protective coating; the composition of the metal being cast in the completed mold; and the end use contemplated for the cast article. Usually, the precursor material, as applied (in one layer or multiple layers, as described below) has a thickness of about 0.01 mm to about 3 mm.

After the precursor material has been sufficiently heat-treated to form the facecoat layer, the molten material for the desired article is introduced into the mold structure, according to any conventional casting technique. (While the molten material could immediately be poured into the mold after the heat treatment, alternatives are possible. For example, the mold could be allowed to cool, e.g., to room temperature, and then pre-heated before the molten material is added).

Figure 2:
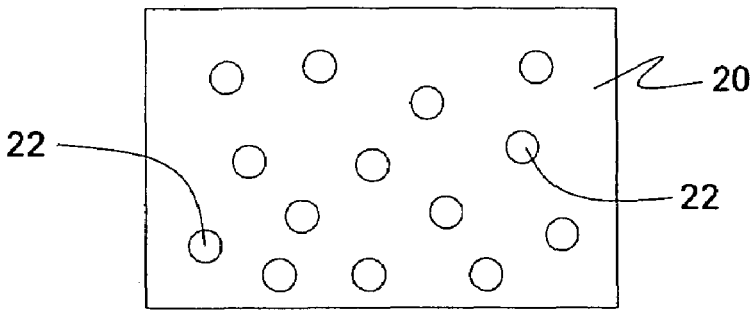
FIG. 2 is a depiction of a two-phase precursor material according to some embodiments of the invention.
Figure 3:
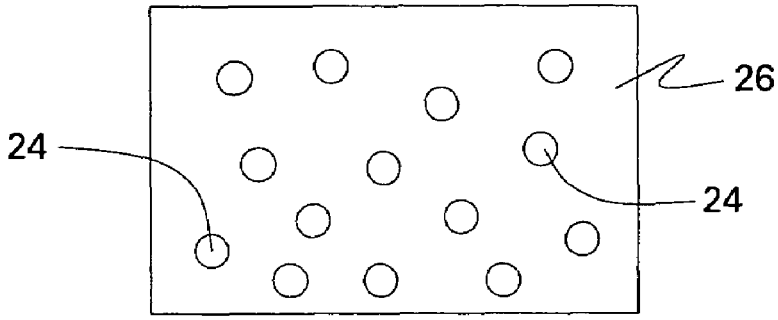
FIG. 3 is a depiction of a two-phase precursor material according to other embodiments of the invention.

The precursor material has generally been described as a single composition. However, in various embodiments of this invention, the precursor can be applied or formed as two or more layers or phases. As an example, the precursor could comprise a continuous facecoat-forming layer 20, as depicted in FIG. 2, wherein the protective layer-forming material would be in the form of a discontinuous phase, e.g., regions 22. Alternatively, the facecoat-forming material 24 could be the discontinuous phase, while the protective layer-former 26 could be the continuous phase, as depicted in FIG. 3. (In both FIGS. 2 and 3, the depicted shape of each phase is not meant to be restrictive. For example, the discrete regions in each instance could exist in a variety of shapes and sizes).

Those skilled in the art are familiar with techniques for preparing and applying a precursor material in the form of multiple phases. The particular technique may involve various factors, e.g., the specific composition of the facecoat- and protective-coating formers; mixing techniques and other preparation steps for the precursor; deposition techniques; and particle sizes for the various constituents in the facecoat-former and the protective coating-former.

Various advantages may arise from the use of multiple phases. For example, the two-phase approach may help to control residual stresses in the mold during casting, and can thereby eliminate or reduce the occasional possibility of crack formation in the facecoat. The two-phase approach can also improve the surface-finish of the cast part.

Figure 4:
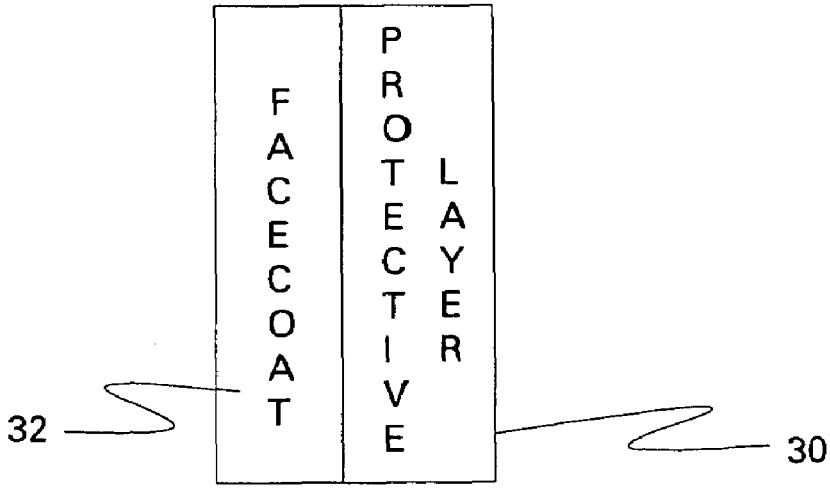
FIG. 4 is a depiction of a two-layer precursor material according to some embodiments of the invention.

There are a number of different schemes for applying the precursor material as two or more layers. One embodiment is depicted in FIG. 4, in which facecoat-forming material 32 and protective coating material 30 are applied as two separate layers. The relative position of the two layers can be changed, depending, for example, on which substrate (mold or core surface) is being coated with the precursor.

In some preferred embodiments, the protective coating-former is the layer which is applied closest to the liquid metal which will eventually be cast. Thus, for the mold structure itself, e.g., an investment casting mold built on a wax pattern, the protective coating-former would usually be applied first, i.e., on the surface of the wax (which will be removed prior to casting). In the case of a core which is being disposed within the mold structure, the facecoat-former would usually be applied first, followed by the protective coating-former, because the latter will eventually be in direct contact with the liquid casting metal. (It should also be noted that the individual layers in FIG. 4 and in other figures discussed below are depicted for simplicity. Thus, the actual, relative thicknesses of the individual layers can vary considerably, as described herein).

As mentioned above, the protective coating-forming constituents and the facecoat-forming constituents are preferably in pseudo-equilibrium with each other during the actual casting steps. This pseudo-equilibrium property is very advantageous when the precursor material is applied as multiple layers. Thus, the respective constituents may undergo some layer-to-layer intermixing, but they remain substantially non-reactive with each other, so that each material can ultimately perform its intended function, i.e., as facecoat or protective coating.

Figure 5:
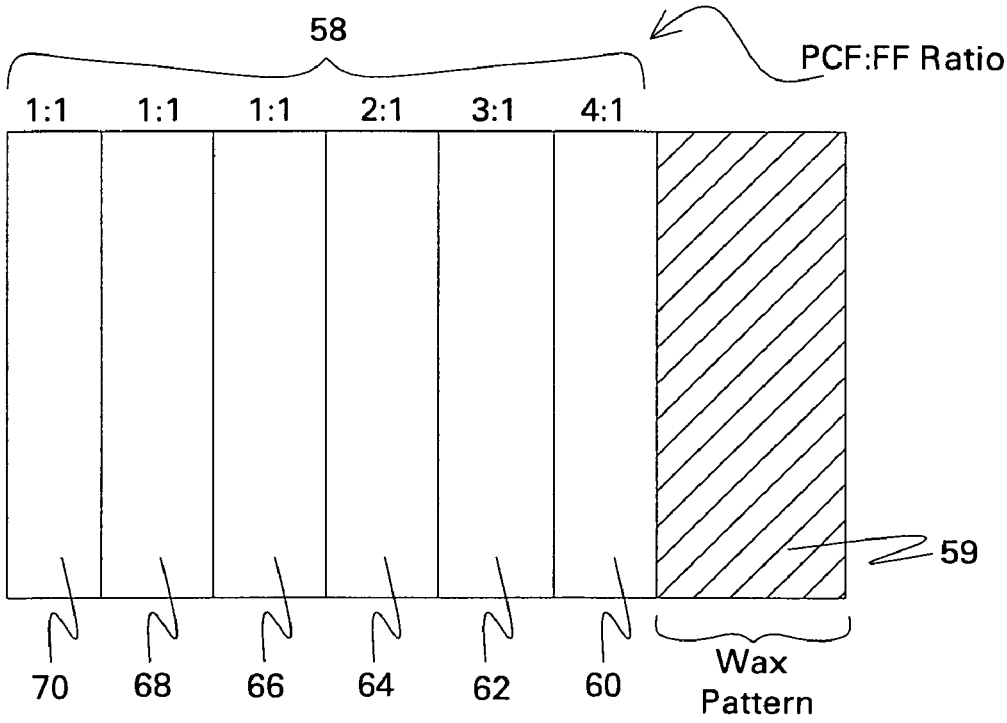
FIG. 5 is a depiction of a compositionally-graded multilayer precursor material according to some embodiments of the invention.

Another alternative is set forth in FIG. 5, in which multiple layers can be compositionally graded. Thus, the relative amount of each facecoat-forming constituent and protective coating-forming constituent can be varied through the overall thickness of the precursor material. As a non-limiting example in the case of a typical shell mold structure, the relative proportion of protective coating-former could be highest in a layer which is closest to the wax pattern, and then gradually decreased in one or more subsequent layers.

As shown in FIG. 5, the precursor material 58 can be formed as multiple layers 60, 62, 64, 66, 68, and 70. Layer 60 would be the first layer applied over the wax pattern 59 of a typical shell mold structure. In this non-limiting illustration, the ratio of protective coating-former ("PCF") to facecoat-former ("FF") might be 4:1 (by weight) in layer 60, progressing to 3:1 in layer 62, and so forth. In some situations, compositional grading can help to reduce or eliminate stresses which might otherwise occur during subsequent heating/cooling cycles, or in subsequent casting. (It should be apparent that compositional grading schemes can also be used when the precursor material is being applied to the cores).

Many variations on the grading concept are possible. For example, continuous grading is not necessary. Thus, layers 66, 68, and 70 in FIG. 5 need not be graded, and can be similar or identical to each other. Furthermore, layer 60 (closest to the wax) could be formed entirely of protective coating material. In general, any of the layer-to-layer changes may vary in degree. Moreover, the composition of each layer may itself vary across the layer's thickness. As an example in the case of a facecoat-forming layer based on materials like yttria and alumina, the ratio or those two materials may be varied across a given dimension, based on factors like material strength and cost.

A very wide variety of refractory materials may be cast according to various embodiments of this invention. These materials comprise silicon and at least one transition metal element, and are often characterized as RMIC materials, which were mentioned above. Non-limiting examples of the transition metal elements are niobium, molybdenum, titanium, chromium, hafnium, and tungsten. As also discussed previously, the niobium-silicon (i.e., niobium-silicide) materials are of special interest for many applications.

Suitable niobium-silicide alloys are described in the following patents, which are all incorporated herein by reference: U.S. Pat. Nos. 5,833,773 (Bewlay et al); 5,932,033 (Jackson et al); 6,419,765 (Jackson et al); and 6,676,381 (Subramanian et al). The niobium-silicide alloys usually have a microstructure comprising a metallic Nb-base phase and an intermetallic metal silicide phase (e.g., Nb-silicide). However, they may include one or more other phases as well. The metallic Nb-phase is relatively ductile, while the intermetallic silicide phase is more brittle and stronger. These alloys may be considered to be a composite of a ductile metallic phase and a brittle strengthening phase, wherein the composite is formed in-situ upon solidification of the alloy. (As used herein, "alloy" is meant to describe a solid or liquid mixture of two or more metals, or one or more metals with one or more non-metallic elements). In some embodiments, the niobium-silicide alloys also include nitrogen, which can improve the high temperature- and/or low temperature properties of the cast article.

The niobium-silicide alloys may further comprise at least one element selected from the group consisting of titanium (Ti), hafnium (Hf), chromium (Cr), and aluminum (Al). Ti and/or Hf are often preferred constituents. A typical range for Ti is about 2 atom % to about 30 atom % (based on total atom % for the alloy material), and preferably, about 12 atom % to about 25 atom %. A typical range for Hf is about 0.5 atom % to about 12 atom %, and preferably, about 2 atom % to about 8 atom %. A typical range for Cr is about 0.1 atom % to about 25 atom %, and preferably, about 2 atom % to about 20 atom %. A typical range for Al is about 0.1 atom % to about 15 atom %, and preferably, about 0.1 atom % to about 4 atom %.

The niobium-silicide alloys may also comprise additional elements. Non-limiting examples are molybdenum, yttrium, tantalum, zirconium, iron, tungsten, germanium, and tin. The particular inclusion and amount for any of these elements will of course depend on a variety of factors, such as the desired properties for the final alloy product.

Various details regarding the casting of these refractory materials are well-known in the art. Non-limiting examples of casting techniques are described in the Subramanian et al patent mentioned above (U.S. Pat. No. 6,676,381). As the molten niobium-silicide or other alloy is poured into the mold, it contacts the inert facecoat of the mold (and as described below, the facecoat of the core, if present). As described above, the facecoat prevents any substantial reaction between the molten metal and the mold, thereby helping to ensure that the casting is defect-free. The effective use of the facecoat as such a barrier between a molten niobium-silicide casting material and a yttrium-silicate mold was experimentally confirmed.

In some preferred embodiments, the mold temperature is lower than the temperature typically used to melt and pour niobium-based RMIC materials. The decreased temperature functions to help prevent premature reaction of the protective coating-constituents with the article being cast. For example, the mold temperature could be more than about 200° C. to about 1500° C. below the melting temperature of the alloy being cast. In some embodiments, casting is carried out while the mold is at room temperature (e.g., "cold mold casting").

A non-limiting illustration can be provided in the case of casting a niobium silicide-type alloy in a yttrium silicate-based mold, covered by a facecoat comprised primarily of yttrium silicate, or yttrium silicate with various rare earth silicates. In such an instance, the mold temperature may be in the range of about 200° C. to about 1600° C., and more specifically, in the range of about 1200° C. to about 1500° C. The desired cast article is then allowed to cool (usually to room temperature).

After the molten material in the mold has been cooled to form the cast article, the protective coating constituent in the precursor material is reacted with the cast article, to form the protective coating on the surface of the article. The reaction is usually initiated by heating. Thus, the mold structure can be heated to a temperature high enough to react substantially all of the protective coating-forming constituents with the article. As an illustration, a silicide-containing protective coating composition can react with a niobium-silicide article, to form a protective coating similar to those conventionally applied to the article.

The temperature required for this reaction will depend on various factors. They include: the specific composition of the cast article and the precursor composition (especially the protective coating-forming constituents of the precursor composition). Other factors include the period of time at which the precursor material is held at the elevated temperature; and the selected thickness for the protective coating. Conventional techniques may be used to heat the precursor material. For example, the entire mold structure can be heated by any suitable convection or conduction mechanism, e.g., a standard furnace.

A non-limiting illustration can also be provided for this reaction step. Thus, in the case of a niobium silicide-type alloy in contact with a silicon/chromium/titanium/niobium protective coating composition, the heat-treatment temperature may be in the range of about 1250° C. to about 1550° C. The "hold time" at that temperature may be about 2 minutes to about 8 hours. Typically, longer hold-time periods can compensate for lower temperatures, within the general range noted above. The presence of the protective coating, as well as its thickness and properties, can be verified by well-known techniques, e.g., optical microscopy; a scanning electron microscope (SEM); and the like.

As mentioned previously, the mold structure would also include any cores which are incorporated within the mold body, and which are used to provide various holes and passageways in the cast article. (Cores are typically fabricated from materials such as yttria, yttrium silicates, zirconium silicates, hafnium silicates, rare earth silicates, vitreous silica, alumina, aluminates, and various combinations thereof). Thus, in many embodiments, the precursor material can be applied over the surface of the core. As in the case of the other mold structure surfaces, the facecoat-forming constituent protects the core, by substantially preventing undesirable reaction between the casting metal and the exterior surface of the core.

Moreover, the protective coating-formers in the precursor material on the core can be induced to react as described previously. For example, the reaction can take place, after casting of the article, when the entire mold structure is heat-treated. In this manner, the protective coating is conveniently formed on the surfaces of the interior regions formed by the core.

The removal of the mold and any cores within the casting can be conveniently carried out during any of the finishing operations. Many conventional techniques—both chemical and mechanical—can be used. In many cases, cores are removed by immersing the cast article in a solution capable of dissolving the core material, e.g., caustic solutions, or in some cases, acid solutions. Autoclave or kettle techniques are often employed, so that the process is efficiently carried out at elevated pressure and temperature. Moreover, similar techniques may be used to dissolve and/or wash away any remaining protective coating precursor material which did not form on the cast article after the heat treatment. Removal of such material could be carried out in a separate treatment step, or as part of the step(s) used to remove cores. It should also be noted that in some cases, core removal could be undertaken after (rather than before) the formation of the protective coating on the cast article.

Figure 6:
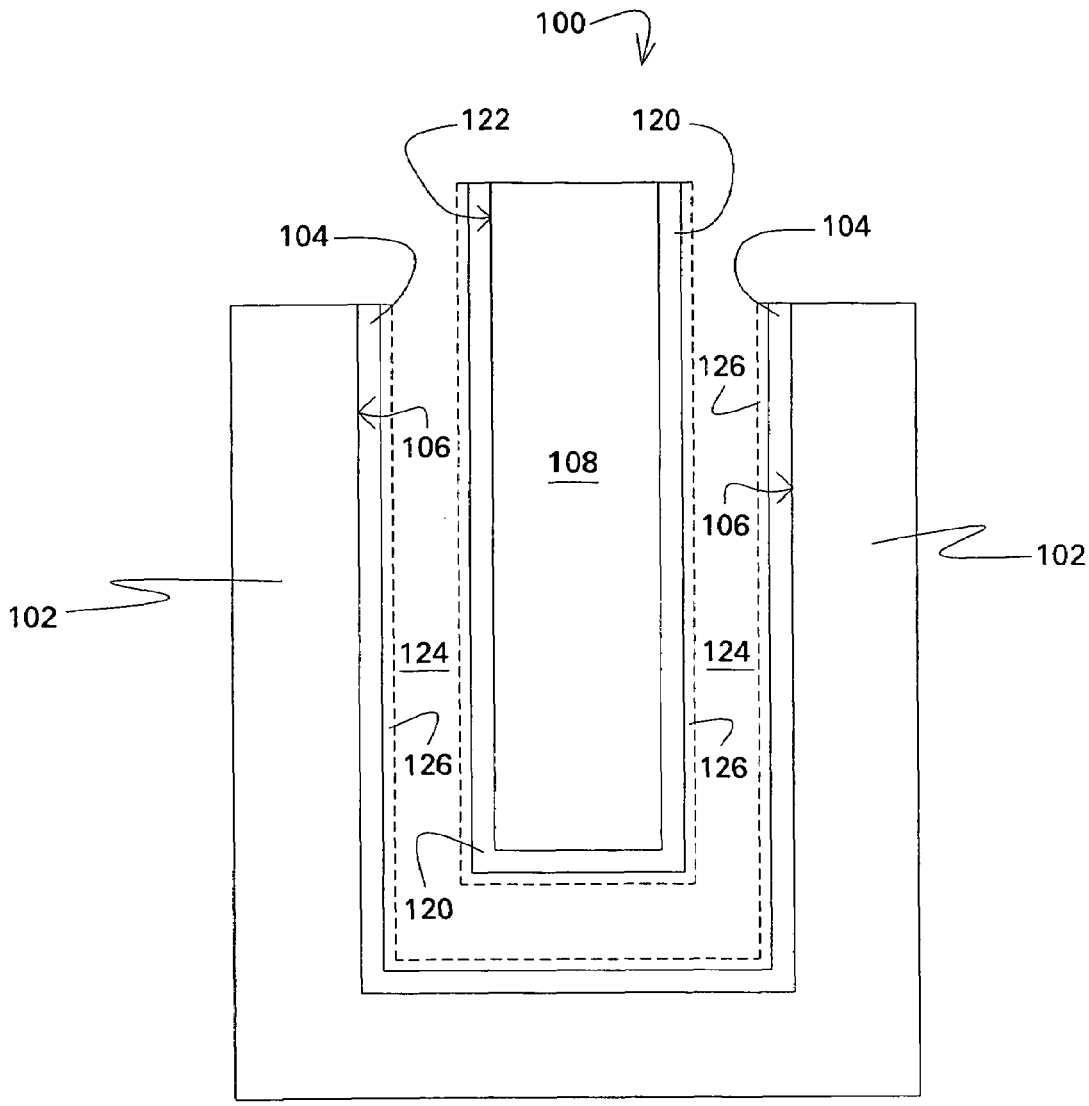
FIG. 6 is a schematic cross-sectional view of a mold assembly, including a shell portion, a core, and a facecoat.

FIG. 6 is a simplified depiction of a mold structure 100, which includes shell portion 102. A facecoat 104 is disposed on an inner surface 106 of shell 102. According to embodiments of the present invention, the facecoat is formed from a precursor material which also comprises a protective coating-former.

Mold structure 100 further includes a core 108. As those skilled in the art understand, the shape and placement of the core are designed to create a cavity or "hollow", after casting and removal of the core. Core 108 also includes facecoat 120, which covers the outer surface 122 of the core. Usually, facecoat 120 has substantially the same composition as facecoat 104, and is deposited as a precursor material at the same time. Moreover, those skilled in the art understand that a shell mold structure or any other type of similar mold assembly can include a variety of other features. Non limiting examples include a pouring cup, e.g., a tundish; reinforcing rods, heater assembly, power supply, cooling jackets, and the like.

When the selected molten alloy (not shown) is poured into cavity 124 during a conventional casting process, facecoats 104 and 120 provide the desired barrier between the molten material and the respective shell surface 106 and core surface 122. After the molten alloy has cooled, the temperature of the precursor material (i.e., the remaining portion of the material) is usually raised according to a suitable time/temperature regimen. As described previously, this post-casting temperature treatment results in the formation of the desired protective coating. For the purpose of illustration, the protective coating for the cast alloy is simply designated with dashed lines, as element 126, which would be disposed on the various surfaces of the article cast within cavity 124. As also mentioned previously, the specific thickness of the protective layer can be varied considerably.

A variety of articles can be formed according to casting methods of the present invention. Many of them are components for turbines, e.g., land-based turbines, marine turbines, and aeronautical turbines. Specific, non-limiting examples of the turbine components are buckets, nozzles, blades, rotors, vanes, stators, shrouds, combustors, and blisks. Non-turbine applications are also possible.

As mentioned above, the protective coatings formed from the precursor material according to this invention can function as the primary protective layer for the niobium component. However, these coatings are often used between the component and an overlying ceramic coating. Thus, many of the coatings can also function as a bonding layer. One example of the ceramic overcoat is a thermal barrier coating (TBC), e.g., one formed from materials like zirconia, stabilized zirconia (e.g., yttria-stabilized), zircon, mullite, and combinations thereof; as well as other refractory materials having similar properties. These coatings, as well as methods for applying them, are well-known in the art. For example, they are described in the previously-referenced patent of Zhao et al, U.S. Pat. No. 6,521,356.

Figure 7:
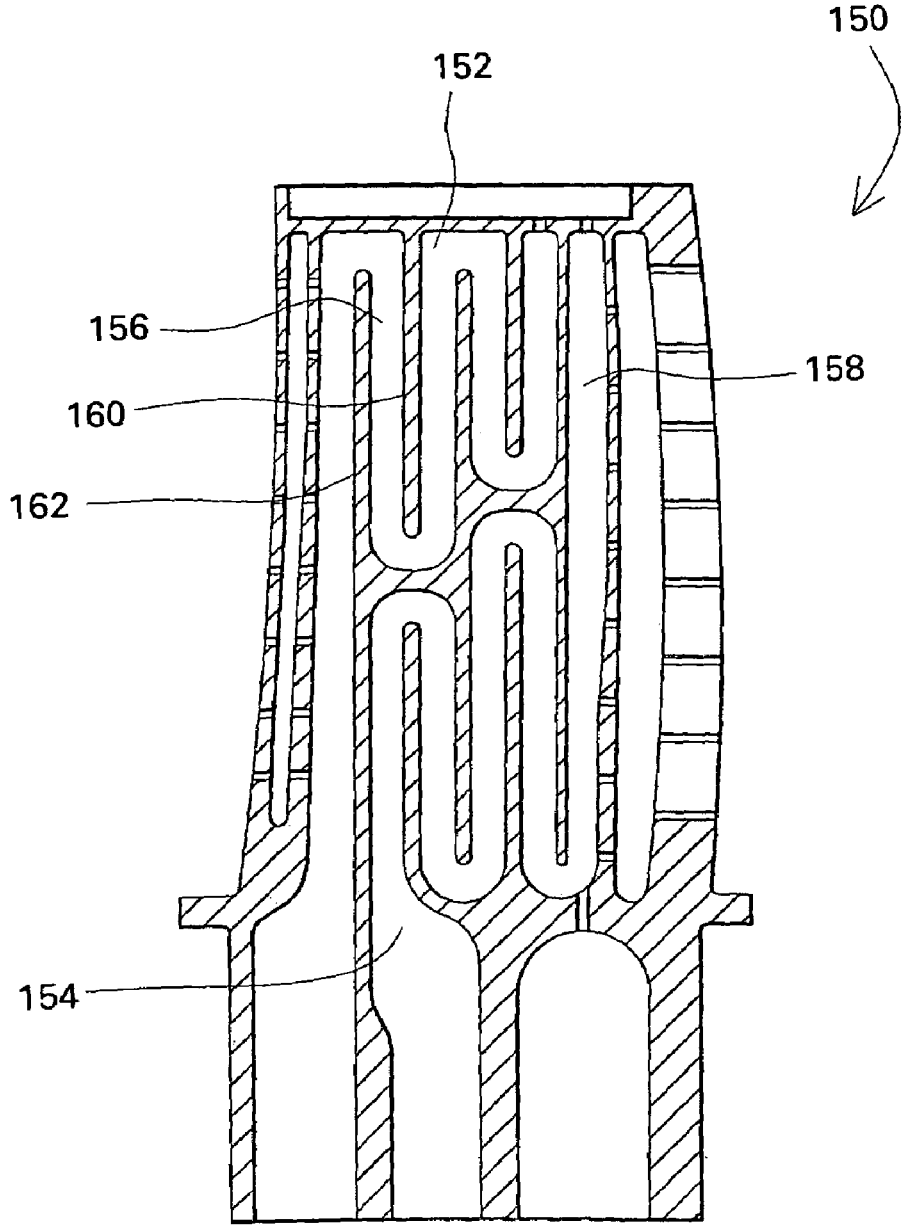
FIG. 7 is a sectional view of an exemplary gas turbine engine airfoil, laid out flat along its chord.

FIG. 7 is a sectional view of an exemplary airfoil (blade) for a gas turbine engine, laid out flat along its chord, and having multi-tier serpentine cooling circuits. This type of blade is generally described in U.S. Pat. No. 6,220,817 (Durgin et al), which is incorporated herein by reference. Blade 150 includes a number of serpentine channels, e.g., 152, 154, 156 and 158, which are formed according to a desired set of cooling circuits. As those skilled in the art understand, the cooling circuits are usually fed from compressor air, and are designed to maintain the various blade components at acceptable temperature limits. The cooling channels are defined by a number of internal ribs, e.g., ribs 160 and 162. Formation of the cooling channels is typically carried out by the use of one or more cores (not shown) within a shell mold, according to conventional casting techniques.

As discussed previously, it is sometimes desirable to provide a protective coating on the surfaces of the cooling channels, e.g., on the surfaces of ribs 160 and 162. Typically, the deposition of such a coating (e.g., an oxidation-resistant coating) on serpentine channels like those shown in FIG. 7 can be extremely time-consuming and difficult. However, according to embodiments of the present invention, the protective coating can be formed as part of the casting process, when a facecoat is used to protect the core material from the material being cast. Thus, the protective coating could be formed on all surfaces of internal ribs 160 and 162. (These would be the surfaces of the channels which were formed by the use of the facecoat-covered core). The formation of the protective coating in this manner provides very notable advantages over processes which were conventional in the art.

Having thus described the invention in rather full detail, it will be understood that such detail need not be strictly adhered to, and that various changes and modifications may suggest themselves to one skilled in the art, all falling within the scope of the invention as defined by the appended claims.

What is claimed is:

1. A method for forming an article, comprising the following steps:

(i) applying a precursor material to at least one surface of a mold structure, and curing the applied precursor material, wherein the precursor material comprises (a) facecoat-forming constituents which are curably converted into a facecoat capable of preventing substantial reaction between the mold structure surface and an article being cast in the mold structure; and (b) a protective coating-former for the article being cast;

(ii) introducing a molten material into the mold structure, and in contact with the facecoat formed from the cured precursor material;

(iii) cooling the molten material, to form the cast article within the mold structure, wherein a surface of the cast article is in contact with the cured precursor material; and (iv) reacting the cured precursor material with the cast article, to form the protective coating on the surface of the cast article, wherein the protective coating-former comprises constituents which are in substantial thermodynamic equilibrium with the facecoat-forming constituents during steps (ii) and (iii), so as to prevent premature reaction of the constituents prior to step (iv); and step (iv) is carried out by heating the cured precursor material under temperature conditions sufficient to react substantially all protective coating constituents with the surface of the cast article which is in contact with the precursor material.

2. The method of claim 1, wherein the facecoat comprises at least one material selected from the group consisting of oxides, silicides, silicates, sulfides, oxysulfides, garnet, alumina, aluminates, and combinations thereof.

3. The method of claim 2, wherein the facecoat further comprises at least one element selected from the group consisting of rare earth metals, refractory metals, and combinations thereof.

4. The method of claim 2, wherein the silicate is selected from the group consisting of yttrium silicates, zirconium silicates, hafnium silicates, rare earth silicates, and combinations thereof.

5. The method of claim 2, wherein the facecoat comprises yttrium monosilicate and free yttria.

6. The method of claim 1, wherein curing in step (i) is carried out under conditions sufficient to remove volatile materials and densify the precursor material to form a facecoat.

7. The method of claim 6, wherein curing in step (i) is carried out by a heat treatment high enough to remove the volatile materials, but low enough to prevent substantial reaction of the facecoat-forming constituents and the protective coating-former.

8. The method of claim 1, wherein the protective coating-former comprises silicon, chromium, and titanium.

9. The method of claim 8, wherein the protective coating-former comprises about 50 atom % to about 90 atom % silicon;

about 2 atom % to about 35 atom % titanium; and about 2 atom % to about 45 atom % chromium.

10. The method of claim 8, wherein the protective coating-former further comprises niobium.

11. The method of claim 10, wherein niobium is present at a level in the range of about 1 atom % to about 35 atom %.

12. The method of claim 8, wherein the protective coating-former further comprises at least one element selected from the group consisting of iron, hafnium, germanium, and aluminum.

13. The method of claim 8, wherein the protective coating-former further comprises at least one element selected from the group consisting of tungsten, molybdenum, tin, nickel, rare earth metals, carbides, and carbide precursors.

14. The method of claim 1, wherein the precursor material is applied as two or more layers or phases.

15. The method of claim 14, wherein one layer of the precursor material comprises facecoat-forming constituents, and a second layer of the precursor material comprises a protective coating-former.

16. The method of claim 14, wherein the precursor material comprises multiple layers applied over each other, and at least two of the layers comprise both facecoat-forming constituents and a protective coating-former.

17. The method of claim 16, wherein the layers which contain both the facecoat-forming constituents and a protective coating-former are compositionally-graded, so that the proportionate amount of facecoat-forming constituents and protective coating-former is varied from layer to layer.

18. The method of claim 1, wherein the precursor material is also applied to the surface of at least one core which is positioned within the mold structure; and then cured on the core surface.

19. The method of claim 18, wherein the core comprises at least one material selected from the group consisting of yttria, yttrium silicates, zirconium silicates, hafnium silicates, rare earth silicates, vitreous silica, alumina, aluminates, and combinations thereof.

20. The method of claim 18, wherein the precursor material which is applied to the surface of the core comprises two or more layers or phases.

21. The method of claim 20, wherein the precursor material applied to the core comprises multiple layers, and at least some of the layers are compositionally-graded.

22. The method of claim 18, wherein the molten material introduced into the mold in step (ii) surrounds the core; and a facecoat formed on the core when the precursor material is cured provides a barrier between the core and the molten material.

23. The method of claim 22, wherein the cured precursor material on the surface of the core is reacted with interior portions of the cast article in contact with the core, thereby forming a protective coating on the interior portions.

24. The method of claim 23, wherein the core is removed after reaction with the interior portions of the article, resulting in a cavity of selected dimensions.

25. The method of claim 1, wherein the mold structure is removed after step (iii).

26. The method of claim 1, wherein the cast article is a turbine component.

27. A method for casting a turbine component, comprising the following steps:

(i) applying a precursor material to at least one surface of a shell mold structure, and curing the applied precursor material, wherein the precursor material comprises (a) facecoat-forming constituents selected from the group consisting of oxides, silicides, silicates, sulfides, oxysulfides, garnet, alumina, aluminates, and combinations thereof; wherein the constituents are curably converted into a facecoat capable of preventing substantial reaction between the mold structure surface and the turbine component being cast in the mold structure; and (b) a protective coating-former for the turbine component, comprising silicon, chromium, and titanium;

(ii) introducing a molten material into the mold structure, and in contact with the facecoat formed from the cured precursor material;

(iii) cooling the molten material, to form the turbine component within the mold structure, wherein a surface of the turbine component is in contact with the cured precursor material; and (iv) reacting the cured precursor material with the turbine component, to form the protective coating on the surface of the component.

28. The method of claim 27, wherein the turbine component comprises a niobium-silicide alloy; the facecoat further comprises at least one element selected from the group consisting of rare earth metals, refractory metals, and combinations thereof; and the protective coating-former further comprises niobium.

29. A precursor material for application to at least one surface of a mold structure suitable for casting refractory metal intermetallic composites, said precursor material comprising:

(A) at least one facecoat-forming constituent suitable for conversion into a facecoat capable of preventing substantial reaction between a surface of the mold structure and an article being cast in the mold structure; wherein the facecoat-forming constituent comprises yttrium monosilicate and free yttria; and (B) a protective coating-former for the article being cast, comprising about 50 atom % to about 90 atom % silicon;

about 2 atom % to about 35 atom % titanium; and about 2 atom % to about 45 atom % chromium;

wherein the protective coating-former comprises constituents which are in substantial thermodynamic equilibrium with the facecoat-forming constituents.

30. The precursor material of claim 29, wherein component (A) comprises at least one material selected from the group consisting of oxides, silicides, sulfides, oxysulfides, garnet, alumina, and aluminates.

31. The precursor material of claim 30, wherein the facecoat further comprises at least one element selected from the group consisting of other rare earth metals, refractory metals, and combinations thereof.

32. The precursor material of claim 29, wherein the protective coating-former further comprises niobium.

33. A mold structure for casting molten material to form an article, comprising (I) a shell for containing the molten material; and (II) a precursor material disposed on at least one surface of the shell, wherein the precursor material comprises:

(a) facecoat-forming constituents which are curably converted into a facecoat capable of preventing substantial reaction between the shell surface and an article being cast in the mold structure; and (b) a protective coating-former for the article being cast.

34. The mold structure of claim 33, wherein the facecoat-forming constituents comprise at least one material selected from the group consisting of oxides, silicides, silicates, sulfides, oxysulfides, garnet, alumina, and aluminates; and the protective coating-former comprises silicon, chromium, and titanium.

35. The mold structure of claim 33, wherein the precursor material is in the form of two or more layers or phases.

36. The mold structure of claim 33, further comprising at least one core positioned within the structure.

37. The mold structure of claim 36, wherein the precursor material is also disposed on the surface of at least one core.

* * * * *